United States Patent [19]

Joutsjoki

[11] 4,332,192

[45] Jun. 1, 1982

[54] ROLL NIP ARRANGEMENT

[75] Inventor: Jukka Joutsjoki, Järvenpää, Finland

[73] Assignee: Oy Wartsila AB, Helsinki, Finland

[21] Appl. No.: 216,771

[22] Filed: Dec. 15, 1980

[30] Foreign Application Priority Data

Dec. 17, 1979 [FI] Finland ..... 793957

[51] Int. Cl.[3] ..... B30B 3/04

[52] U.S. Cl. ..... 100/168; 100/47; 72/240

[58] Field of Search ..... 100/46, 47, 168, 169, 100/170, 171, 172, 176, 162 B, 258 A, 258 B; 162/272, 368, 373, 381; 72/240, 248; 68/260

[56] References Cited

U.S. PATENT DOCUMENTS 723,591 3/1903 Dyer ..... 100/258 R
1,469,689 10/1923 Privs ..... 100/258 R
2,961,901 11/1960 Wheeler ..... 72/240 X
3,594,274 7/1971 Claessens ..... 100/170 X

*Primary Examiner*—Peter Feldman
*Attorney, Agent, or Firm*—McAulay, Fields, Fisher, Goldstein & Nissen

[57] ABSTRACT

A paper web treatment device is disclosed, which includes a nip forming roll pair. One of the rolls of the pair comprises a mantle portion rotatable on a central shaft portion. This roll is arranged to be moved in a radial direction for disengagement from the other roll. There are means for producing a mechanically guided rotary motion at both ends of the shaft portion simultaneously with the radial motion of the roll. The shaft portion is used as a rigid member mechanically interconnecting the rotary motions at both ends of the roll, thereby synchronizing the radial motions of both ends for obtaining exact parallel disengagement of the movable roll from the other roll.

3 Claims, 2 Drawing Figures

ROLL NIP ARRANGEMENT

A paper web treatment device or the like including a nip forming roll pair, in which at least one of the rolls comprises a mantle portion rotatable on a central shaft portion, said roll being arranged to be moved in a radial direction for disengagement from the other roll of said roll pair.

In roll nips applied for treatment of a continuous web, in particular, when one roll is a so called soft or elastic roll, a problem is to obtain a sufficiently fast movement of the rolls radially out of contact from each other, for avoiding damages in the soft roll, if, for instance, due to web rupture, web accumulations are formed in the nip. It is thereby of importance that the movement at both ends of the roll to be moved is equal with respect to speed as well as distance. This is because the rolls might be several meters long and quite heavy, whereby even small differences in the roll end movements may result in an unsatisfactory separation of the rolls. If the soft roll is damaged, the roll nip is no longer capable of performing a faultless treatment, and the damaged roll must be replaced. This in turn causes production breaks and extra costs.

The object of the invention is to provide a construction, by means of which damages caused by web accumulations or the like can more easily be avoided. The invention is characterized in that there are means for producing a mechanically guided rotary motion at both ends of said shaft portion simultaneously with said radial motion whereby said shaft portion is used as a rigid member mechanically interconnecting the rotary motions at both ends of said roll, thereby synchronizing the radial motions of both ends for obtaining parallel disengagement of the rolls of said roll pair. Thus, according to the invention, the shaft portion of the moving roll itself is used for synchronizing the rotary motions at both ends of the roll, so that the angles of rotation will be the same at both ends, whereby also the radial motions will be equal. By this means the risk that a web accumulation appearing in the nip would damage the soft roll, can be substantially reduced.

In a favourable embodiment of the invention, the means producing a mechanically guided rotary motion of the roll to be moved, comprise a rack-and-pinion mechanism at both ends of the shaft portion of said roll. In another embodiment of the invention, said means comprise a lever mechanism, at both ends of said shaft portion, whereby one end of a lever is rigidly attached to the shaft portion of the roll and the other end of said lever is turnably linked to a fixed point. Naturally, also other known menhanisms can be used for producing said mechanically guided rotary motion of the roll to be moved.

Figure 1:
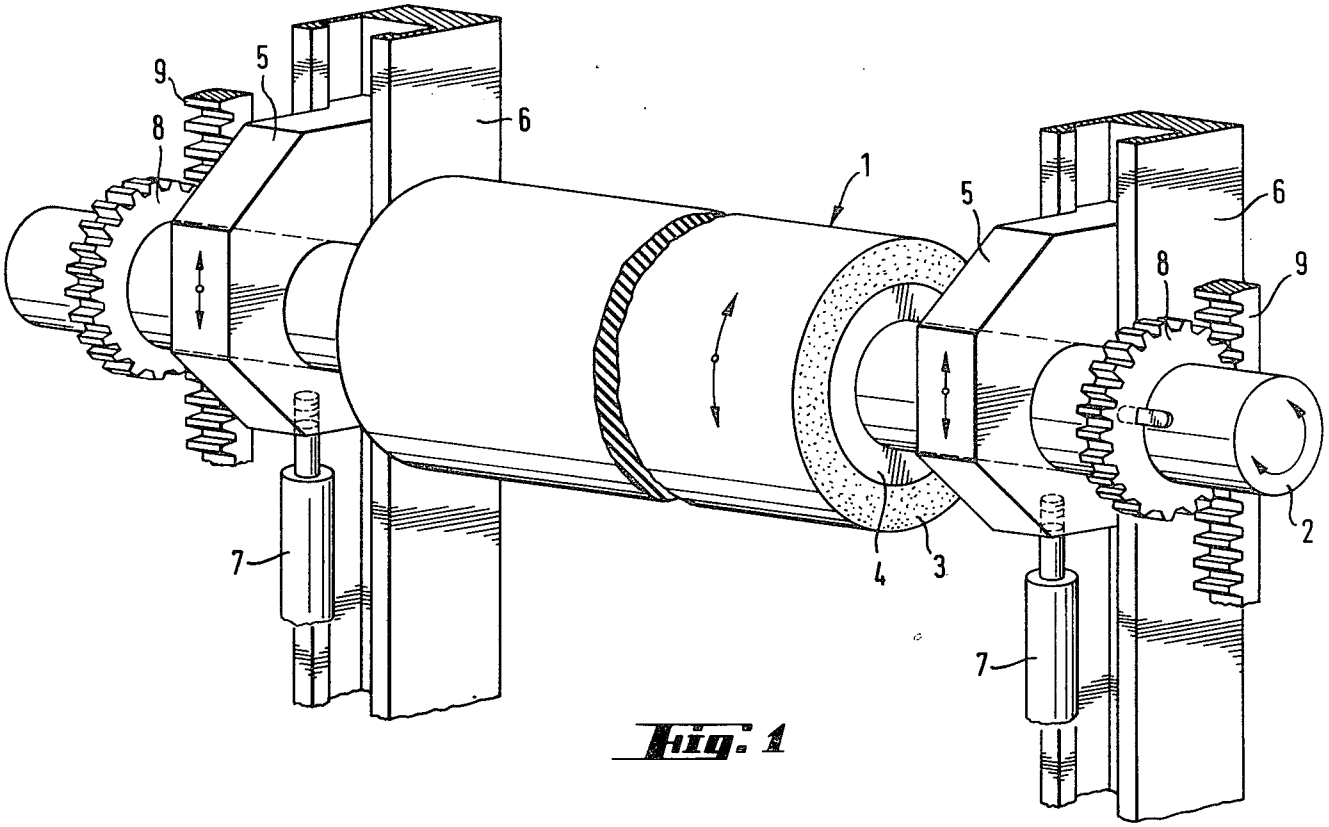
Figure 2:
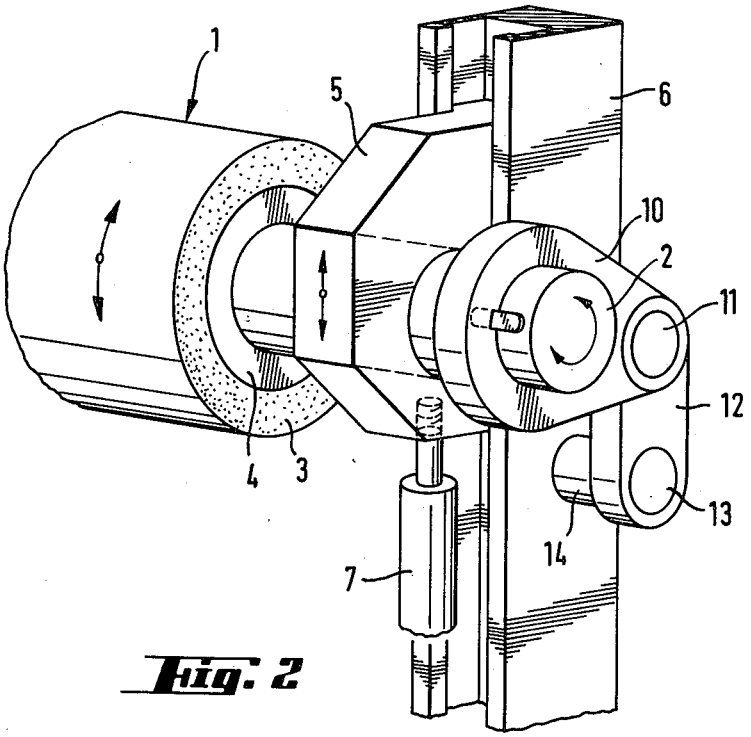

In the following, the invention will be described more in detail, with reference to the attached drawing, in which FIG. 1 shows schematically one enbodiment of the invention and FIG. 2 shows schematically another embodiment of the invention.

Reference numeral 1 indicates the radially movable roll of a roll nip. For making the representation clearer the other roll of the nip is not shown. Roll 1 has a shaft portion 2, on which a mantle portion 3 is journalled by means of bearings 4. The radial motion of roll 1 is guided by a guiding member 5 sliding along a guide rail 6. A power cylinder 7 is connected to guiding member 5 for effecting said radial motion. Naturally, also other means can be used for this purpose.

In the embodiment according to FIG. 1, a gear wheel 8, co-operating in the manner of a rack-and-pinion mechanism with a rack 9, is rigidly fastened to shaft portion 2. In normal service, mantle portion 3 of roll 1 rotates on shaft portion 2 and is compressed against another roll (not shown) to form a nip, in which a running web is treated. Shaft portion 2 is not rotating. If a web accumulation or another considerably thick portion appears in the web, the power cylinders 7, at both ends of roll 1, are activated to move roll 1 radially out of contact with the other roll of the nip. At the same time, shaft portion 2 is, due to the influence of rack-and-pinion mechanism 8, 9, mechanically guided at both its ends to perform a rotary motion. Thereby, shaft portion 2 acts as a rigid element synchronizing the motions of both ends of roll 1, so that both ends move radially by an equal amount. The motion directions are shown by arrows.

FIG. 2 shows only the mechanism used at one end of the radially movable roll 1. It should be understood that the opposite end of the roll is provided with a similar mechanism.

The function of the embodiment shown in FIG. 2 corresponds in principle to the function of the embodiment of FIG. 1, but the mechanical guiding of the rotary motion of shaft portion 2 is carried out differently. In this case, a lever 10 is rigidly attached to shaft portion 2. This lever is via pivots 11 and 13 and another lever 12 supported at a fixed point 14, which may be a portion of the frame of the device. In this embodiment, lever 10, at both ends of roll 1, acts in the same way as gear wheel 8 to ensure, in cooperation with rigid shaft portion 2, parallel motion of roll 1.

The invention is not limited to the embodiments shown, but several modifications thereof are feasible within the scope of the attached claims.

I claim:

1. A paper web treatment apparatus or the like including a nip forming roll pair, at least one of the rolls in said roll pair being radially movable and having a mantle portion rotatable on a central shaft portion, said movable roll being connected to a device for moving it in a radial direction for disengagement from the other roll of said roll pair, said device comprising means for producing a mechanically guided rotary motion at both ends of said shaft portion simultaneously with said radial motion, said shaft portion forming a rigid member mechanically interconnecting said rotary motions at both ends of said movable roll, thereby synchronizing said radial motions of both ends of said movable roll for obtaining parallel disengagement of said movable roll from the other roll of said roll pair.

2. An apparatus according to claim 1, in which said means comprise a rack-and-pinion mechanism at both ends of said shaft portion.

3. An apparatus according to claim 1, in which said means comprise a lever mechanism at both ends of said shaft portion, said mechanism including a lever having one end rigidly attached to said shaft portion and the other end turnably linked to a fixed point.

* * * * *